US006832571B2

(12) United States Patent
Eagles

(10) Patent No.: US 6,832,571 B2
(45) Date of Patent: Dec. 21, 2004

(54) SEGMENT FORMED FLEXIBLE FLUID CONTAINMENT VESSEL

(75) Inventor: Dana Eagles, Sherborn, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/016,640

(22) Filed: Oct. 30, 2001

(65) Prior Publication Data

US 2003/0081862 A1 May 1, 2003

(51) Int. Cl.[7] ..... B65D 88/78

(52) U.S. Cl. ..... 114/256; 383/107

(58) Field of Search ..... 114/256, 74 R, 114/74 T; 383/107, 108; 112/441; 428/130, 57; 2/275; 24/459, 462, 389; 160/380, 392, 395, 402; 220/684

(56) References Cited

U.S. PATENT DOCUMENTS

| | | | |
|---|---|---|---|
| 34,426 | A | 2/1862 | Howard |
| 130,303 | A | 8/1872 | Libby |
| 143,661 | A | 10/1873 | Blake |
| 154,725 | A | 9/1874 | Street |
| 389,615 | A | 9/1888 | Townsend |
| 1,447,981 | A | 3/1923 | Henderson |
| 1,702,593 | A | 2/1929 | Pierce |
| 1,723,307 | A | 8/1929 | Sipe |
| 1,921,015 | A | 8/1933 | Young |
| 2,065,480 | A | 12/1936 | Soper |
| 2,115,368 | A | 4/1938 | Lustberg |
| 2,350,158 | A | 5/1944 | Evans |
| 2,371,404 | A | 3/1945 | Mumford |
| 2,372,632 | A | 3/1945 | Webb |
| 2,391,926 | A | 1/1946 | Scott |

(List continued on next page.)

FOREIGN PATENT DOCUMENTS

| | | | |
|---|---|---|---|
| DE | 2413383 | A | 10/1975 |
| DE | 198 21 465 | A | 11/1999 |
| EP | 0 134 706 | A | 3/1985 |
| EP | 0 710 736 | A1 | 11/1994 |
| EP | 0 687 625 | | 12/1995 |
| EP | 0 862 870 | A | 9/1998 |
| EP | 0 832 032 | B1 | 4/1999 |
| FR | 1210934 | A | 10/1959 |
| FR | 2 325 837 | | 4/1977 |
| FR | 2595621 | | 9/1987 |
| GB | 824 984 | A | 12/1959 |
| GB | 826 301 | A | 12/1959 |
| GB | 891121 | A | 3/1962 |
| GB | 907 266 | | 10/1962 |
| GB | 933 889 | A | 8/1963 |
| GB | 1 079 766 | | 8/1967 |
| GB | 1117552 | | 6/1968 |
| GB | 1117553 | | 6/1968 |
| JP | 60 219243 | A | 11/1985 |
| WO | WO 97/14622 | A | 4/1997 |
| WO | WO 97/49541 | | 12/1997 |
| WO | WO 98/01359 | A | 1/1998 |
| WO | WO 01 63033 | | 8/2001 |

OTHER PUBLICATIONS

*McGraw–Hill Encyclopedia of Science and Technology, 6th Edition*, 1987, McGraw–Hill Book Company, New York XP00220369918, pp. 247–248 Paragraph 4; figures 6–8.

"3–D Braided Composites—Design and Applications" by D. Brookstein, 6th European Conference on Composite Materials, Sep. 1993, pp. 225–230.

Pages from web site of Bradley Textiles, Inc.

(List continued on next page.)

*Primary Examiner*—Andrew Wright
(74) *Attorney, Agent, or Firm*—Frommer Lawrence & Haug LLP; Ronald R. Santucci

(57) ABSTRACT

A flexible fluid containment vessel or vessels fabricated out of segments of fabric clamped together for transporting and containing a large volume of fluid, particularly fresh water.

11 Claims, 4 Drawing Sheets

U.S. PATENT DOCUMENTS 2,406,830 A 9/1946 Haman et al.
2,492,699 A 12/1949 Houwink
2,595,408 A 5/1952 Quest
2,597,401 A * 5/1952 Swanson ..... 160/90
2,674,287 A 4/1954 Smith et al.
2,685,964 A 8/1954 Brown
2,724,358 A 11/1955 Harris et al.
2,725,027 A 11/1955 Brandon et al.
2,794,192 A 6/1957 Paris
2,854,049 A 9/1958 Wyllie
2,939,501 A 6/1960 Corman et al.
2,968,272 A 1/1961 Berglund
2,979,008 A 4/1961 Whipple
2,997,973 A 8/1961 Hawthorne et al.
2,998,793 A 9/1961 Hawthorne et al.
3,001,501 A 9/1961 Hawthorne et al.
3,018,748 A 1/1962 Denis et al.
3,045,310 A * 7/1962 Velinsky ..... 24/462
3,056,373 A 10/1962 Hawthorne et al.
3,067,712 A 12/1962 Koerpinghaus
3,150,627 A 9/1964 Stewart et al.
3,167,103 A 1/1965 Hawthorne et al.
3,224,403 A 12/1965 Paddington
3,246,621 A 4/1966 Copeland
3,282,361 A 11/1966 Mackie
3,289,721 A 12/1966 Benson
3,296,994 A 1/1967 Schirtzinger
3,502,046 A 3/1970 Stauber
3,561,219 A 2/1971 Nishizawa
3,622,437 A 11/1971 Hobaica et al.
3,661,693 A 5/1972 Pierson
3,668,745 A * 6/1972 Krupp ..... 24/389
3,672,319 A 6/1972 Platzer
3,686,064 A 8/1972 Bonnet et al.
3,721,603 A 3/1973 Takeda
3,739,410 A 6/1973 Fortin
3,762,108 A 10/1973 Pierson
3,774,563 A 11/1973 Anderson, Sr. et al.
3,779,196 A 12/1973 Knaus et al.
3,797,445 A 3/1974 Zeimer
3,812,805 A 5/1974 Forssell et al.
3,816,885 A * 6/1974 Saether ..... 24/462
3,839,977 A 10/1974 Bradberry
3,875,623 A * 4/1975 Johnston ..... 24/580.1
3,952,679 A 4/1976 Grihangne
3,955,524 A 5/1976 Renoux
3,974,789 A 8/1976 DeGroot
4,108,101 A 8/1978 Schirtzinger
4,190,010 A 2/1980 Bibby
4,227,474 A 10/1980 Ullrich
4,227,477 A 10/1980 Preus
4,227,478 A 10/1980 Preus
4,230,061 A 10/1980 Roberts
4,373,462 A 2/1983 Fish
4,399,765 A 8/1983 Alkner et al.
4,446,181 A 5/1984 Wood
4,468,812 A 8/1984 Grosvenor
4,478,661 A 10/1984 Lewis
4,506,623 A 3/1985 Roper et al.
4,508,582 A 4/1985 Fink
4,509,558 A 4/1985 Slater
4,510,201 A 4/1985 Takeuchi et al.
4,530,868 A 7/1985 Shinmi
4,582,756 A 4/1986 Niinuma et al.
4,641,400 A * 2/1987 Moreland ..... 24/389
4,662,386 A 5/1987 Pedersen
4,668,545 A 5/1987 Lowe
4,726,986 A 2/1988 Cannady, Jr. et al.
4,747,170 A * 5/1988 Knouse ..... 5/81.1 HS
4,910,817 A 3/1990 Tetsuo
4,933,231 A 6/1990 Seber
4,948,658 A 8/1990 Haelker
4,998,498 A 3/1991 Gallichan
5,082,726 A 1/1992 Bastiaens et al.
5,194,459 A 3/1993 Sato et al.
5,203,272 A 4/1993 Kassinger et al.
5,235,928 A 8/1993 Shank, Jr.
5,238,537 A 8/1993 Dutt
5,243,925 A 9/1993 Fortenberry
5,262,230 A 11/1993 Becker et al.
5,355,819 A 10/1994 Hsia et al.
5,360,656 A 11/1994 Rexfelt et al.
5,391,424 A 2/1995 Kolzer
5,413,065 A 5/1995 Spragg et al.
5,421,128 A 6/1995 Sharpless et al.
5,431,970 A 7/1995 Broun et al.
5,482,763 A 1/1996 Shaffer
5,488,921 A 2/1996 Spragg
5,503,291 A 4/1996 Craig
5,505,557 A 4/1996 Bradley
5,544,612 A 8/1996 Eymard
5,657,714 A 8/1997 Hsia et al.
5,691,390 A 11/1997 Harrison et al.
5,713,399 A 2/1998 Collette et al.
5,735,083 A 4/1998 Brown et al.
5,780,144 A 7/1998 Bradley
5,790,304 A 8/1998 Sanders et al.
5,865,045 A 2/1999 Wagner et al.
5,885,679 A 3/1999 Yasue et al.
5,902,070 A 5/1999 Bradley
5,921,421 A 7/1999 Fuquan
5,951,345 A 9/1999 Perratone et al.
6,003,565 A 12/1999 Whittier, II et al.
6,047,655 A 4/2000 Cran
6,056,438 A 5/2000 Bradley
6,086,968 A 7/2000 Horovitz
6,101,964 A 8/2000 Lesesne
6,186,701 B1 2/2001 Kempers
6,290,818 B1 9/2001 Romanski
6,293,217 B1 9/2001 Savage et al.
6,330,865 B1 12/2001 Cran
6,474,022 B1 * 11/2002 Double et al. ..... 52/3
6,497,934 B1 12/2002 Mahn, Jr. et al.
6,550,410 B2 * 4/2003 Reimers ..... 114/256
6,675,734 B2 1/2004 Eagles et al.
2003/0081862 A1 5/2003 Eagles

OTHER PUBLICATIONS

International Search Report issued by European Patent Office on Jul. 9, 2002 for PCT/US02/10694 filed Apr. 5, 2002.

International Search Report issued by European Patent Office for corresponding international application PCT/US02/10586 mailed Sep. 26, 2002.

International Search Report issued by the European Patent Office on Feb. 6, 2003 for PCT/US02/34299.

International Search Report issued by the European Patent Office on Feb. 10, 2003 for PCT/US02/34052.

International Search Report issued by the European Patent Office on Mar. 12, 2003 for PCT/US02/34004.

* cited by examiner

SEGMENT FORMED FLEXIBLE FLUID CONTAINMENT VESSEL

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and the method of making the same.

BACKGROUND OF THE INVENTION

The use of flexible containers for the containment and transportation of cargo, particularly fluid or liquid cargo, is well known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, since a seamed structure is an alternative to a simple woven fabric and would have different advantages thereto, particularly in the fabrication thereof, it would be desirable if one could create a seamed tube that was not prone to failure at the seams.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips. The fabric strip of yarn material, preferably being a flat-woven fabric strip, has longitudinal threads which in the final base fabric make an angle in what would be the machine direction of the press felt.

During the manufacture of the base fabric, the fabric strip of yarn material is wound or placed spirally, preferably over at least two rolls having parallel axes. Thus, the length of fabric will be determined by the length of each spiral turn of the fabric strip of yarn material and its width determined by the number of spiral turns.

The number of spiral turns over the total width of the base fabric may vary. The adjoining portions of the longitudinal edges of the spirally-wound fabric strip are so arranged that the joints or transitions between the spiral turns can be joined in a number of ways.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of non-woven material or of non-woven material with melting fibers. The edge joint can also be obtained by providing the fabric strip of yarn material along its two longitudinal edges with seam loops of a known type, which can be joined by means of one or more seam threads. Such seam loops may for instance be formed directly of the weft threads, if the fabric strip is flat-woven.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

It should be noted that U.S. Pat. No. 5,902,070 entitled "Geotextile Container and Method of Producing Same" issued My 11, 1999 and assigned to Bradley Industrial Textiles, Inc. does disclose a helically formed container. Such a container is, however, intended to contain fill and to be stationary rather than a transport container.

Accordingly, while a FFCV formed in segments is desirable, whether formed spirally or in a patch work, avoidance of failure at the seams is a critical necessity.

SUMMARY OF THE INVENTION

It is therefore a principal object of the invention to provide for an FFCV which is made in segments which are joined together in a secure fashion.

It is a further object of the invention to provide for an FFCV wherein the segments which make it up are capable of being attached together in a convenient manner.

A yet further object of the invention is to provide for joining segments together by a means wherein only one side of the FFCV, preferably the outside, is where joining together takes place.

Accordingly, the present invention is directed towards providing a means for joining segments of fabric together to create an FFCV. In this regard, the present invention provides for a clamping mechanism to secure adjacent lengths of fabric together. The clamping mechanism entails creating a C-shaped portion along the edge of the fabric segment and placing the C-shaped portion into and/or abutting one side of, for example, a rigid member or an adjacent so formed C-shaped member on an adjacent fabric segment and then a clamp is secured about the structure thereby clamping the segments together. Glue or a sealing compound may also be used between the portions as an alternative to the rigid member or in conjunction therewith. This would be repeated so as to secure all the segments making up the tube which forms the FFCV.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENT

Figure 1:
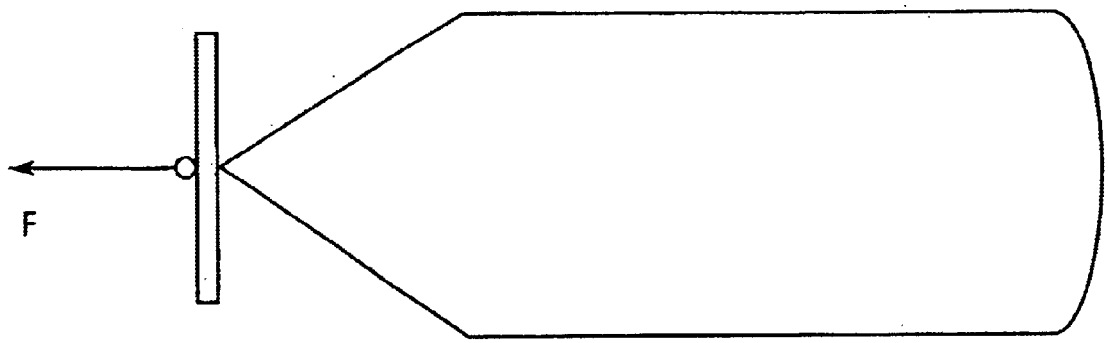
FIG. 1 (PRIOR ART)
FIG. 1 is a somewhat general perspective view of a prior art FFCV which is cylindrical having a pointed bow or nose.
Figure 2:
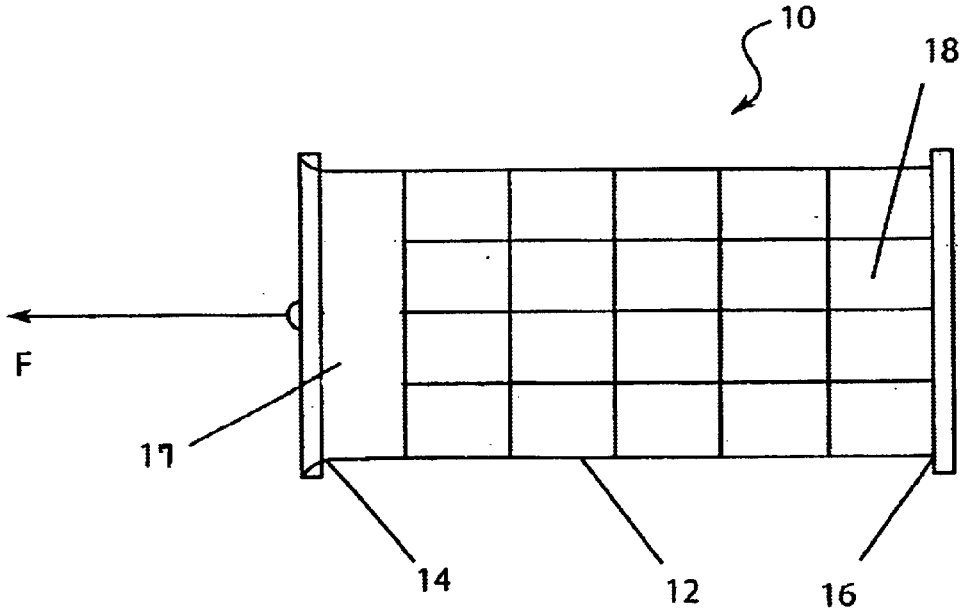
FIG. 2 is a somewhat general perspective view of an FFCV which is formed in segments, incorporating the teachings of the present invention.
Figure 2A:
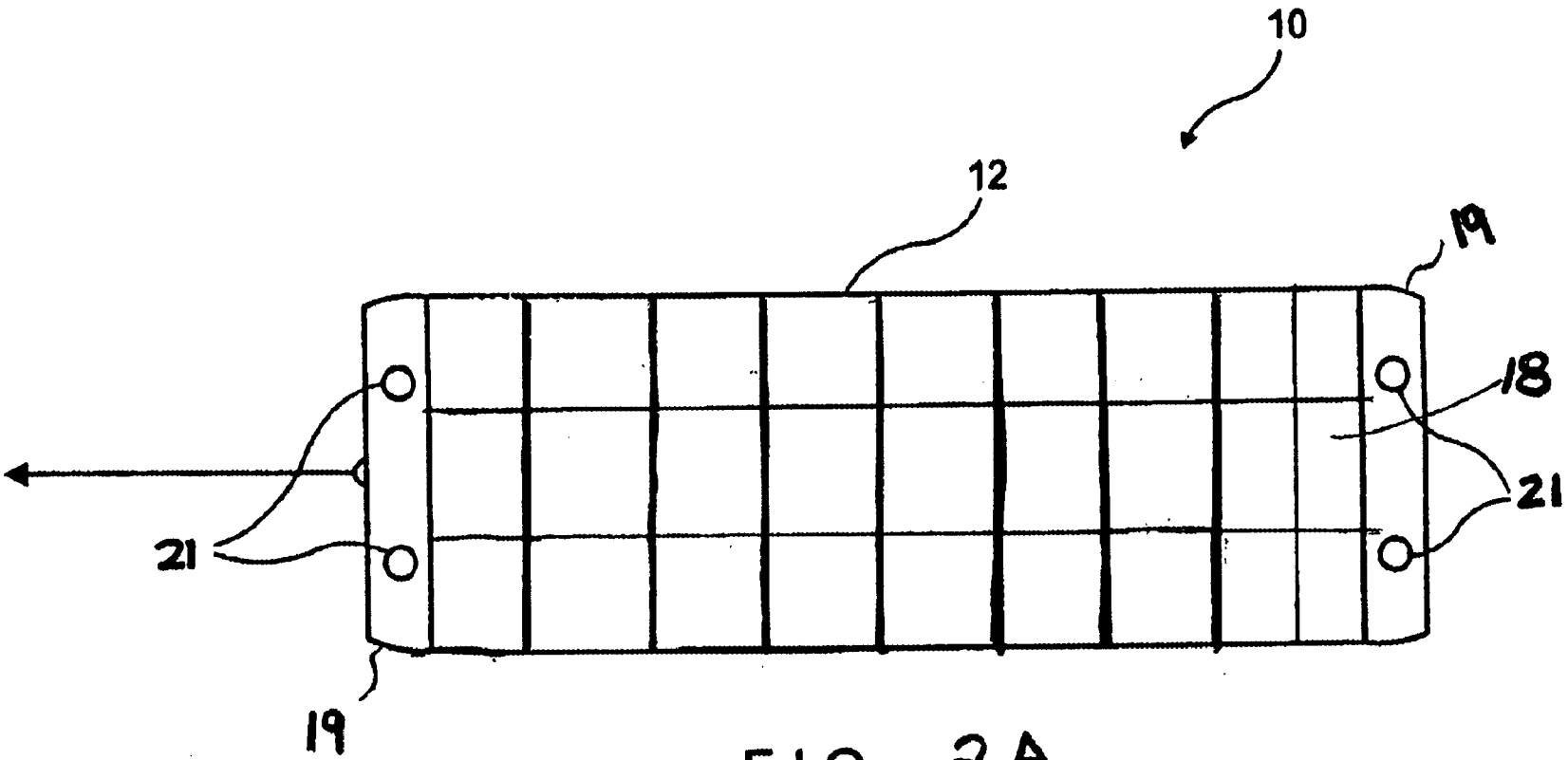
FIG. 2A is a somewhat general perspective view of an FFCV, incorporating the teachings of the invention.

The proposed FFCV 10 is intended to be constructed of an impermeable textile tube. The tube's configuration may vary. For example, as shown in FIG. 2, it would comprise a tube 12 having a substantially uniform diameter (perimeter) and sealed on each end 14 and 16. The respective ends 14 and 16 may be closed, pinched, and sealed in any number of ways. A means for loading and unloading cargo would be provided. For example, as shown in FIG. 2A, end caps 19 may fill and empty FFCV 10 via Ports 21. The resulting impermeable structure which is fabricated out of segments or sections of material 18 will be flexible enough to be folded or wound up for transportation and storage.

In designing the FFCV to withstand the loads placed thereon, certain factors should be considered. In this regard, in co-pending U.S. patent application Ser. No. 09/832,739 filed Apr. 11, 2001 entitled "Flexible Fluid Containment Vessel" such factors are set forth in detail, along with possible materials for the fabric making up the segments 18, their construction and possible coatings and methodology to apply to it to render the fabric impermeable, in addition to other features which may be desirable with regard to the FFCV.

Accordingly, further discussion thereof will not be repeated herein; rather reference is made to said application. Also, the present device may have application with regard to the spiral formed FFCV as disclosed in co-pending U.S. patent application Ser. No. 09/908,877 filed Jul. 18, 2001 entitled "Spiral Formed Flexible Fluid Containment Vessel". While there is discussed therein means and methods for joining the wound strips together to form an FFCV, the present device may provide an alternative thereto for all or part of the joining process. For example, in high load portions of the FFCV, typically the front and rear, one methodology may be used. For less stressful locations another methodology may be used.

In addition, reference is made to U.S. patent application Ser. No. 09/921,617 filed Aug. 3, 2001 entitled "End Portions for a Flexible Fluid Containment Vessel and a Method of Making the Same" which relates to possible construction of the end portions of the FFCV and U.S. patent application Ser. No. 09/923,936 filed Aug. 7, 2001 entitled "Coating for a Flexible Fluid Containment Vessel and a Method of Making the Same" which discloses additional construction for the fabric for the segment in addition to possible coatings therefor.

Figure 3:
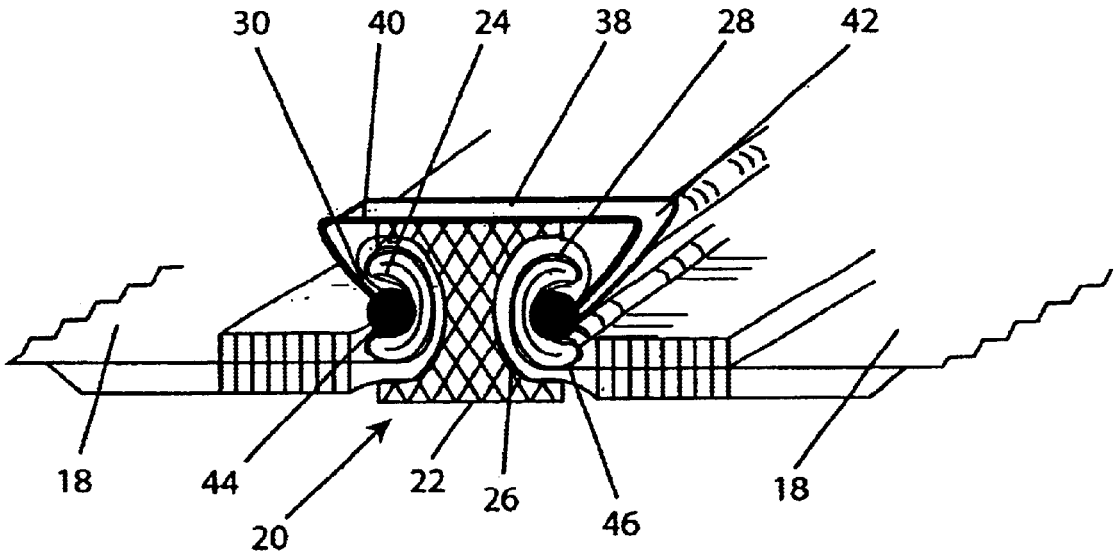
FIG. 3 is a side sectional view of the clamping mechanism incorporating the teachings of the present invention.
Figure 4A:
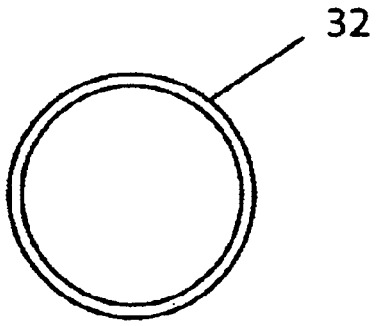
FIGS. 4A–4C are side sectional views of the formation of the C-shaped section located at the edge of the segment prior to clamping.
Figure 4B:
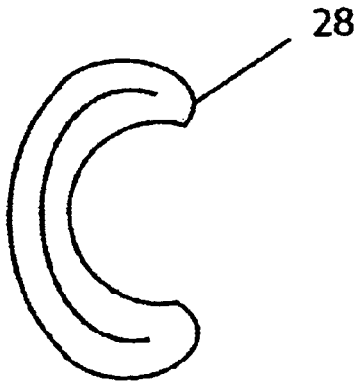
Figure 4C:
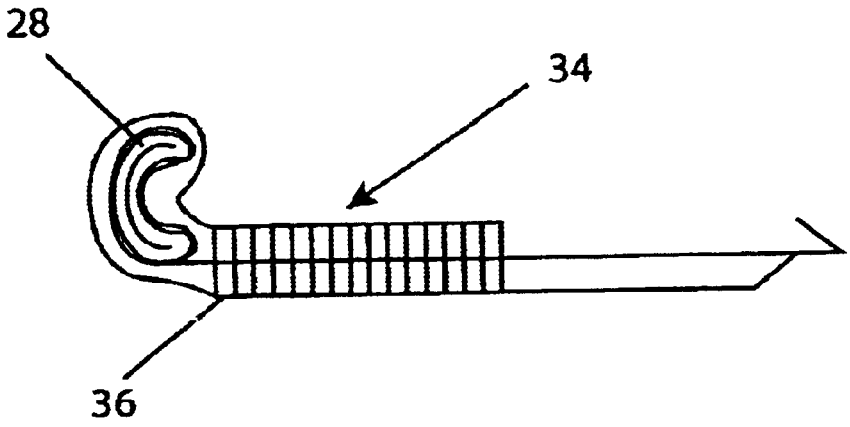

With all of this in mind, we turn now more particularly to FIGS. 3 through 4C where like elements are similarly numbered. In this regard, FIG. 3 shows a cross section view of the clamping mechanism or device 20 joining two segments 18 of fabric. As aforesaid, the fabric segments 18 can be that of a patchwork to create the FFCV, wound strip or of other configuration suitable for the purpose.

One of the advantages of the particular configuration is that it can be affixed and serviced, if necessary, from only one side of the FFCV, preferably the outside or seawater side.

The clamping device 20 comprises an elongated member 22 which is shown as being I-shaped but may also be L-shaped or any other shape suitable for the purpose. Member 22 may be made of a flexible resilient material which allows it to bend as is necessary when the FFCV is folded or wound up when emptied. Member 22 includes opposite C-shaped receiving portions 24 and 26 for matingly receiving respective C-shaped members 28 and 30, the formation of which will be discussed.

In this regard, the C-shaped members 28 and 30 may be made separate from the fabric segments 18 and attached or from the fabric segments themselves, which would depend upon the fabric structure and composition. For example, if the fabric's structure allowed it to be gathered at its end to form a C-shaped member, such a member so formed could be retained in shape by gluing, sewing, thermal bonding, coating or any other means suitable for the purpose. If the fabric does not lend itself to such gather, then the C-shaped member can be made separately and attached to the body of the fabric. In this regard, reference is now made to FIGS. 4A–4C.

In these figures, the C-shaped members 28 and 30 are fabricated and secured to the fabric body in the following manner. A braided or woven tube 32 of fabric is formed for the length of the segment 18. The tube 32 is then folded inwardly as shown in FIG. 4B to create the C-shaped members. It may be fixed in this shaped by way of gluing, sewing or any other means suitable for the purpose. After being so formed, the C-shaped member may be rendered impermeable to fluid by, for example, coating or by other means. A C-shaped member is then affixed to the end of the segment 18 by wrapping the end portion 34 thereof about the C-shaped member and sewing or gluing overlap 36 thereby fixedly securing it thereto. This will provide a flexible structure allowing it to be rolled up on a reel or folded for storage and transportation.

Of course other means of creating the C-shaped member on the end of the segments 18 will be apparent to those skilled in the art. Also, while a C-shaped member is shown and described, other shaped members suitable for the purpose should be apparent to those skilled in the art.

Returning now to FIG. 3, respective segments 18 having C-shaped members 28 and 30 can now be joined together by placing said members into opposite sides of the I-shaped member 22. A U-shaped clamp 38 is then spring loaded, snapped or crimped thereover. In this regard, legs 40 and 42 of clamp 38 are provided with enlarged portions 44 and 46 which are sized to fit within the C-shaped members 28 and 30. The clamp 38 secures the two segments together and creates a seal as between the C-shaped members 28 and 30 and the I-shaped member 22. If necessary, a sealing glue or coating can also be used therebetween or an alternative to using a rigid member 22 all together.

Note, the clamp 38 may be made of metal, composite or any other material that allows for effective clamping of the segments. Also, the length of the clamp 38 used should be sufficient for effective clamping but should not be so sized so as to interfere with the reeling up or folding of the FFCV.

In addition, clamping together could be effected by a rope sewn along the C-shaped members by way of a number of sewing means and techniques as will be apparent to those skilled in the art. Also, the C-shaped members themselves can be sewn together with an appropriate sealing therebetween.

An FFCV formed of such segments has obvious attendant advantages. The fabrication of segments rather than a seamless structure allows them to be flat woven of various lengths and widths. For example, one of the dimensions of the segment 17 can be equal to the circumference of the FFCV 10 and formed into a tubular structure as seen in FIG. 2. The variations are endless. It also allows them to be rendered impermeable prior to joining them together, since the segments can be pre-coated. Also, to ensure a leak free seal, it may be produced either by adding additional sealant to the surface in the area of the overlap 34 after attaching the C-shaped members, or using a bonding process that results in sealed bond at the overlap 34 such as a curable polymeric sealant (an adhesive) such as a curable polyurethane. For example, an ultrasonic bonding or thermal bonding process (see e.g. U.S. Pat. No. 5,713,399) could be used with a thermoplastic coating to result in a leak free area. If the fabric segments were not pre-coated, or if it was desired to coat the structure after fabrication, appropriate methods of accomplishing the same are set forth in the aforesaid patent application.

As part of the coating process there is envisioned the use of a foamed coating on the inside or outside or both surfaces of the fabric segments. A foamed coating would provide buoyancy to the FFCV, especially an empty FFCV. An FFCV constructed from materials such as, for example, nylon, polyester and rubber would have a density greater than salt water. As a result the empty FFCV or empty portions of the large FFCV would sink. This sinking action could result in higher stresses on the FFCV and could lead to significant difficulties in handling the FFCV during filling and emptying of the FFCV. The use of a foam coating provides an alternative or additional means to provide buoyancy to the FFCV.

Also, in view of the closed nature of the FFCV, if it is intended to transport fresh water, as part of the coating process of the inside thereof, it may provide for a coating which includes a germicide or a fungicide so as to prevent the occurrence of bacteria or mold or other contaminants.

In addition, since sunlight also has a degradation effect on fabric, the FFCV may include as part of its coating, or the fiber used to make up the fabric segments, a UV protecting ingredient in this regard.

Although a preferred embodiment has been disclosed and described in detail herein, its scope should not be limited thereby; rather its scope should be determined by that of the appended claims.

What is claimed is:

1. A flexible fluid containment vessel for the transportation of cargo comprising a fluid or fluidisable material, said vessel comprising:

an elongated flexible tubular structure having a circumference comprised of at least two fabric segments having a width which is smaller than a width of the tubular structure, said structure having an inside and an outside;

means for rendering said tubular structure impervious;

said tubular structure having a front end and a rear end;

means for filling and emptying said vessel of cargo;

means for joining said segments together;

said means for joining comprising a first upright member on a surface of a first segment along an edge thereof; a second upright member on a surface of a second segment along an edge thereof; wherein said first and second upright members are aligned, means for sealing a space between said first and second segments and means for securing said first and second upright members together; and wherein said means for securing said first and second upright members is only affixed either on said inside or on said outside of said first and second segments.

2. A vessel in accordance with claim 1 wherein a length of said first segment or said second segment is equal to that of the circumference of the tubular structure.

3. A vessel in accordance with claim 1 wherein said means for securing said members together includes stitching said members together.

4. A vessel in accordance with claim 3 which further includes rope as part of the stitching.

5. A flexible fluid containment vessel for the transportation of cargo comprising a fluid or fluidisable material, said vessel comprising:

an elongated flexible tubular structure having a circumference comprised of at least two fabric segments having a width which is smaller than a width of the tubular structure, said structure having an inside and an outside;

means for rendering said tubular structure impervious;

said tubular structure having a front end and a rear end;

means for filling and emptying said vessel of cargo;

means for joining said segments together;

said means for joining comprising a first upright member on a surface of a first segment along an edge thereof; a second upright member on a surface of a second segment along an edge thereof; wherein said first and second upright members are aligned, means for sealing a space between said first and second segments and means for securing said first and second upright members together; and wherein said means for securing said first and second upright members is only affixed either on said inside or on said outside of said structure and wherein said upright members are generally C-shaped and said means for sealing a space includes a means having respective complimentary shaped portions to receive said C-shape.

6. A vessel in accordance with claim 5 wherein said means for sealing a space has generally an I-shape.

7. A vessel in accordance with claim 6 wherein said means for securing said first and second upright members together comprises a generally U-shaped clamp which maintains said C-shape members in a clamping arrangement with each other and the I-shaped sealing means therebetween.

8. A vessel in accordance with claim 5 wherein said upright members are formed from the edge of said first segment or said second segment.

9. A vessel in accordance with claim 5 wherein said upright members are fixedly secured to the edge of said first segment or said second segment.

10. A vessel in accordance with claim 9 wherein said upright members are maintained within an overlap formed from the edge of said first segment or said second segment.

11. A vessel in accordance with claim 10 wherein said overlap is sewn or glued to the surface of said first segment or said second segment.

* * * * *